US010164410B2

(12) United States Patent
Andersson et al.

(10) Patent No.: US 10,164,410 B2
(45) Date of Patent: Dec. 25, 2018

(54) SPARK PLUG EXTENSION

(71) Applicant: SEM AB, Amal (SE)

(72) Inventors: Lars-Ake Andersson, Amal (SE); Jorgen Bengtsson, Svanskog (SE); Bert Gustafsson, Amal (SE)

(73) Assignee: SEM AB, Amal (SE)

( * ) Notice: Subject to any disclaimer, the term of this patent is extended or adjusted under 35 U.S.C. 154(b) by 138 days.

(21) Appl. No.: 14/401,163

(22) PCT Filed: May 14, 2013

(86) PCT No.: PCT/SE2013/050535

§ 371 (c)(1),
(2) Date: Nov. 14, 2014

(87) PCT Pub. No.: WO2013/172771

PCT Pub. Date: Nov. 21, 2013

(65) Prior Publication Data

US 2015/0136098 A1 May 21, 2015

(30) Foreign Application Priority Data

May 14, 2012 (SE) ..... 1250485

(51) Int. Cl.
*H01F 38/12* (2006.01)
*H01T 13/04* (2006.01)
(Continued)

(52) U.S. Cl.
CPC ..... *H01T 13/04* (2013.01); *F02P 3/02* (2013.01); *H01F 38/12* (2013.01); *H01T 13/44* (2013.01); *Y10T 29/49231* (2015.01)

(58) Field of Classification Search
USPC ..... 123/634
See application file for complete search history.

(56) References Cited

U.S. PATENT DOCUMENTS 5,357,233 A 10/1994 Wada
6,114,935 A * 9/2000 Oosuka ..... H01F 38/12 336/107

(Continued)

FOREIGN PATENT DOCUMENTS

EP 0987435 A2 3/2000
WO WO 2010/081124 A2 7/2010

OTHER PUBLICATIONS

International Search Report and Written Opinion dated Dec. 6, 2013 for PCT/SE2013/050535, 7 pages.

*Primary Examiner* — Lindsay Low
*Assistant Examiner* — Ruben Picon-Feliciano
(74) *Attorney, Agent, or Firm* — John M. Harrington, Esq.; Johnson, Marcou & Isaacs, LLC

(57) ABSTRACT

The following invention relates to an ignition coil assembly for an ignition system comprising an ignition coil where said assembly has a main axis and is configured for insertion into and/or removal out of a well associated with an internal combustion engine, wherein the assembly comprises an elongated extension body made of flexible material, said extension body comprising an upper end portion and a lower end portion wherein the extension body is arranged to be transversally bendable in relation to the main axis so that the upper end portion and the lower end portion may assume an angle (α) in relation to each other.

12 Claims, 5 Drawing Sheets

(51) Int. Cl.
*F02P 3/02* (2006.01)
*H01T 13/44* (2006.01)

(56) References Cited

U.S. PATENT DOCUMENTS

2005/0110604 A1* 5/2005 Fujiyama ..... H01F 3/14
336/90
2010/0175653 A1* 7/2010 Lykowski ..... H01T 13/04
123/143 C
2010/0225222 A1* 9/2010 Bishop ..... H01T 13/20
313/141

* cited by examiner

SPARK PLUG EXTENSION

CROSS REFERENCE TO RELATED APPLICATIONS

This application is a 35 U.S.C. § 371 national stage of International Application No, PCT/SE2013/050535 filed on May 14, 2013, published in English under PCT Article 21(2), which claims the benefit of priority to Swedish Patent Application No. 1250485-8 file on May 14, 2012, the disclosures of which are hereby incorporated by reference.

TECHNICAL FIELD

The present invention relates to an ignition coil assembly for a spark ignited internal combustion engine comprising an ignition coil where said assembly has a main axis and is configured for insertion in a spark plug well.

BACKGROUND ART

Internal combustion engines comprise spark plugs for initiating combustion driving the engine piston and require a spark to ignite the compressed fuel. Conventionally an ignition coil transforms the battery's low voltage to high voltage needed to create an electric spark in the spark plugs to ignite the fuel. Common for all plugs is that they are arranged to be fitted into a well on the cylinder head piercing the wall of the combustion chamber so that the ignition terminal is brought into contact with the interior of the combustion cylinder. Direct ignition systems, where the ignition coil is mounted directly above each spark plug, are known to be advantageous since they eliminate the need of spark-plug wires and reduces leakage current as well as it makes ignition timing-control easier. Such a system is disclosed in EP0987435. These direct ignition systems are usually made up as one integrated assembly comprising both the spark plug as well as the ignition coil, whereby the spark plug is connected to the coil via an interconnecting extension body. The size (length) of the extension body in its turn is dependent on the dimensions of the motor. Spark ignited engines are sometimes designed with a vast distance (often at least 150 mm, sometimes as much as 500 mm) between the engine head and the internal combustion cylinder leading to that large spark plug constructions are needed in order for the ignition terminal to reach the cylinder. In some cases this is due to that the spark ignited engine originates from a converted diesel engine. As a diesel engine lacks spark plugs they are not designed to be serviced and the engine is therefore normally not adapted to promote easy access of any plug. Nevertheless, converting diesel engines into spark ignited engines represent a fast growing area, partly due to an increasing environmental awareness, and the ability of converting a diesel engine leads to the possibility of adapting vehicles already in use (e.g. lorry trucks, city busses etc.) to become e.g. gas-compatible.

U.S. Pat. No. 5,357,233 discloses an ignition apparatus for an internal combustion engine for providing a peaked high voltage current from an ignition coil to a spark plug through a bendable extension device including a first portion extending from the ignition coil, a second portion adapted to be connected to the spark plug and an elastic member connecting the first member to the second member so that the first member moves elastically in relation to the second member.

However, the space available under the hood is often rather limited, even quite narrow, and the lack of space may lead to difficulties when removing and/or introducing the ignition coil assembly from/into the motor. This problem leads to a need of costly design of extensions, e.g. dividing it in several parts.

DISCLOSURE OF THE INVENTION

It is an object of the present invention to solve, or at least to minimise the above mentioned problems, providing an easy and quick way of removing/introducing the ignition coil assembly from/into an engine cylinder head. This is achieved by an ignition coil assembly according to the appended claim 1, wherein the assembly comprises an elongated and flexible extension body which comprises an upper end portion and a lower end portion and where said extension body is arranged to be transversally bendable in relation to a main axis so that the upper end portion and the lower end portion of the extension body may assume an angle in relation to each other between 0 -360°.

In one embodiment the extension body interconnects a spark plug receiving end portion and the ignition coil to each other. Thanks to that the extension body is transversally bendable in relation to the main axis, the spark plug receiving end portion and the ignition coil of the assembly may be configured to assume an angle in relation to each other.

In a preferred aspect of the invention the extension body is made of a flexible material such as rubber. It is to be understood that the term "flexible" is to be interpreted as capable of being bent without breaking.

Thanks to the invention there is achieved an assembly which is very easy to handle and which may be configured to fit a large variety of engine types, having various dimensions of the well. Thanks to the extension body the assembly can be adapted in length to a particular well, and due to the flexible property of the extension body, the ignition coil assembly can even be designed to fit deep wells (i.e. requiring a long extension body) without running into practical difficulties when removing/introducing the assembly due to limited space inside the motor compartment. In case of a very lengthy assembly, which normally would pose a problem in a narrow motor compartment, an assembly body according to the invention may simply be bent (e.g. during removal of the assembly) and can thus be adapted to the space available around the well under the hood of the vehicle. Furthermore, it facilitates providing compact engine compartments.

According to yet another aspect of the invention, said ignition coil is detachably arranged within a first joining section at an upper end portion of the extension body.

According to yet another aspect of the invention, the spark plug is detachably arranged within a detachable spark plug boot which is removably mounted at a lower end portion of the extension body. Preferably said spark plug boot is made of a flexible and heat resistant material such as silicone rubber, arranged to tightly embrace the spark plug to provide an isolating layer and prevent leakage of high voltage current. In a preferred embodiment the spark plug boot is arranged to be fitted within an adapter unit (a spark plug boot adapter) which in its turn is attached to a second joining section at the lower end portion of the extension body. The adapter unit is preferably made of a heat resistant and isolating material, such as ceramics or high temperature plastic, whereby there is achieved an efficient insulator between the spark plug and the second lowermost joining section of the assembly. Thanks to this aspect there is achieved the benefit that the soft and heat sensitive parts of the assembly, such as the extension body often being made of a resilient material such as rubber, are protected from the heat of the spark plug and are therefore also kept from destruction. An overheated rubber part could otherwise cause the assembly to break down which may result in difficulties during removal of the assembly or replacement of parts, and/or cause leakage of current. Preferably the spark plug boot is easy to detach from the spark plug adapter and at the same time is dimensioned with regards to its diameter to allow for a spark plug socket to reach the spark plug.

DETAILED DESCRIPTION

The invention will hereinafter be described in more detail with reference to the appended drawings. The following description should be considered as preferred form only, and is not decisive in a limiting sense.

Figure 2:
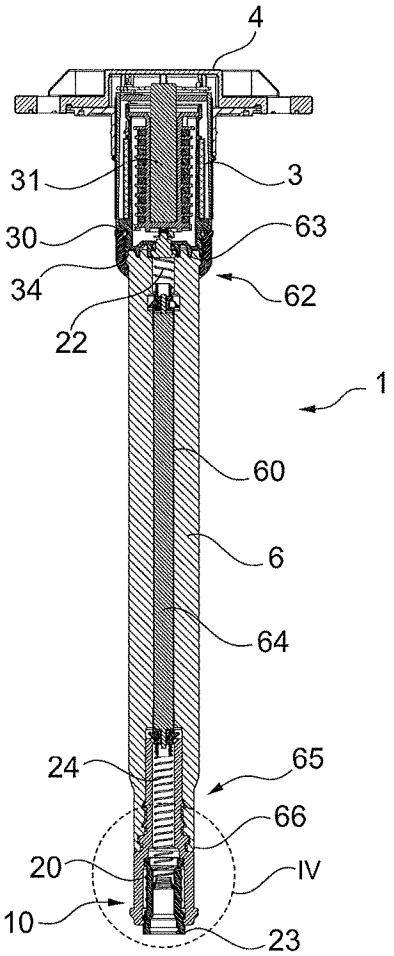
FIG. 2 is a cross sectional view of an assembly according line II in FIG. 1.
Figure 1:
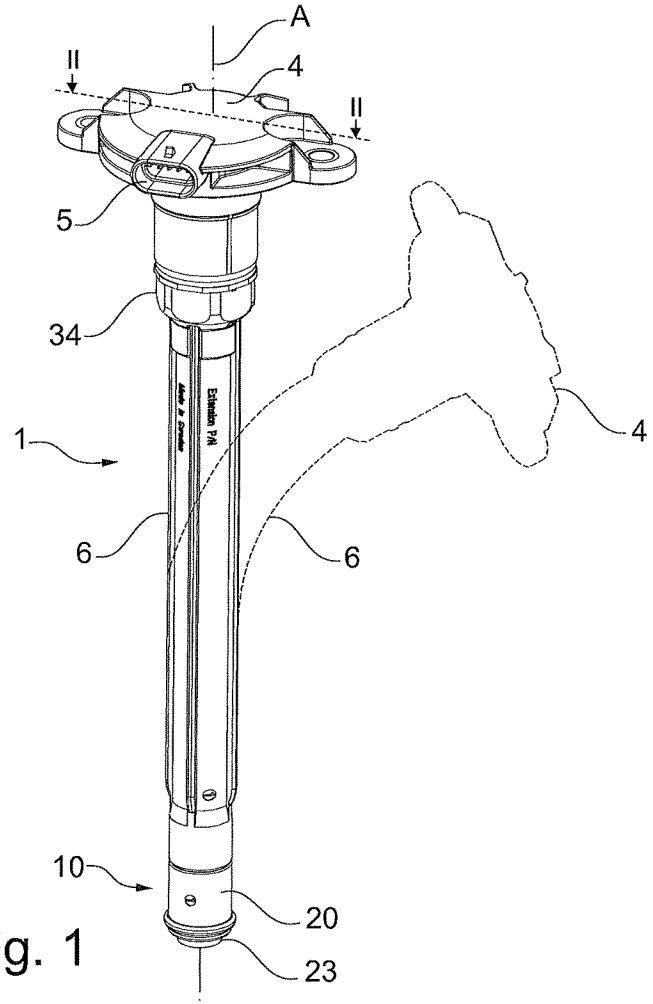
FIG. 1 is a perspective view of an assembly according to one embodiment of the invention, where a bent configuration is illustrated in dashed lines.

In FIGS. 1-6 the ignition coil assembly is generally designated 1. In FIG. 1 is shown a perspective view of an embodiment of an assembly 1 according to the invention, and FIG. 2 shows a cross section of the assembly according to line II in FIG. 1. The main parts of the assembly 1 comprise a spark plug receiving end portion 10, an ignition coil 3 and an elongated extension body 6. The assembly 1 is configured for insertion in a well 90 of a cylinder head 9 (see FIGS. 3*a*-*b*) which is associated with an internal combustion engine. The spark plug receiving end portion 10 and the coil 3 are connected to each other by means of the elongated extension body 6 which comprises an inner, generally cylindrical, through bore 60 through which there is arranged an interconnecting member, for instance in the form of a flexible conductor device such as one or several cable/s 64 or a connecting spring, electrically connecting a spark plug 2 inserted into the spark plug receiving end portion 10, and said coil 3. Any commercially available ignition cable can be used. At each end portion of the cable 64 there is preferably arranged connections which is intended for retaining an upper 22 and a lower 24 contact spring. In accordance herewith, in one embodiment there is provided an upper contact spring 22 between the cable 64 and the coil 3 and a lower contact spring 24 between the cable 64 and a spark plug 2 which is positioned at the spark plug receiving end portion 10. Said contact springs 22, 24 safeguards electrical connection between the ignition coil 3 and a spark plug 2. It is to be understood that the contact springs 22, 24 and the cable 64 may be replaced by one extended contact spring connecting the spark plug and the coil. It is further understood that the interconnecting member 64 is a flexible interconnecting conductor of suitable kind, and is not to be limited to cables or springs.

In a preferred embodiment the assembly 1 is generally cylindrical and has a main axis "A", and said elongated extension body 6 is arranged to be transversally bendable in relation to the main axis A so that the spark plug receiving end portion 10 and the ignition coil 3 may be configured to assume an angle $\alpha$ in relation to each other. The assembly 1 is shown in a bent configuration by means of dashed lines in FIG. 1 in which position the extension body 6 has been bent so that its upper end portion 62 and its lower end portion 65 have assumed an angle a in relation to each other. Theoretically said angle $\alpha$ may be between 0-360°, however it is most likely that it will lie be between 90-180°. Bending is achieved by means of said extension body 6 being made of a flexible, resilient material, which allows for e.g. bending the assembly 1 without breaking it. One suitable material for said extension body could be rubber.

The ignition coil 3, comprising a core 31 and coils 32, is detachably arranged within a first joining section 63 located at the upper end portion 62 of the extension body 6, and is beneficially positioned inside an ignition coil casing 30. The ignition coil casing 30 is arranged to be attached onto the first joining section 63 by means of a coupling sleeve 34 being threaded, or attached in any other suitable way, onto the exterior of the extension body 6 and the coil casing 30 respectively, adjoining and retaining the two parts. Thus, in one embodiment said ignition coil casing 30 is provided with outer threading matching the inner threading of the coupling sleeve 34.

Figure 3B:
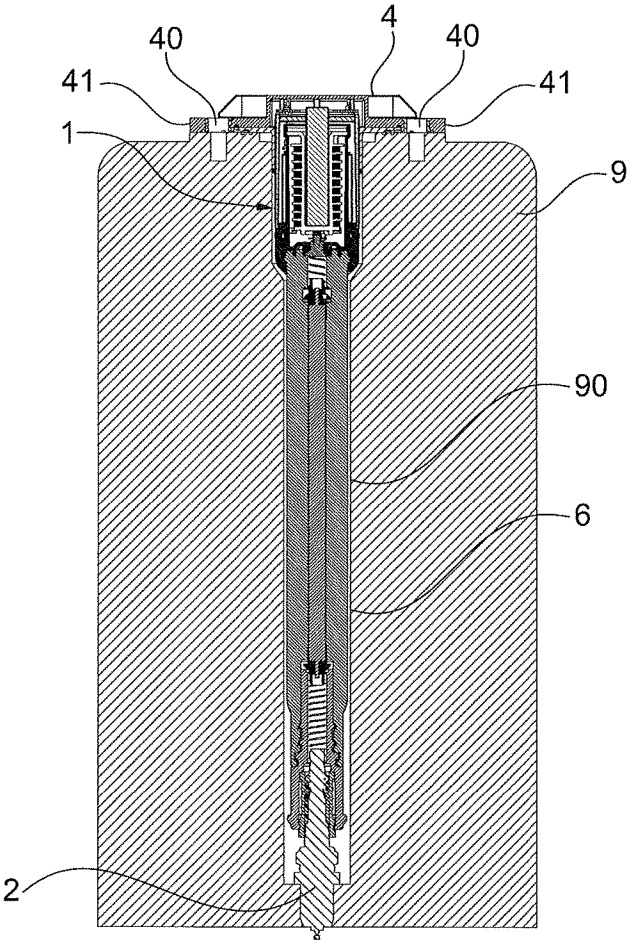
FIG. 3*b* is a cross sectional view of of an assembly being introduced into a well of an cylinder head.
Figure 3A:
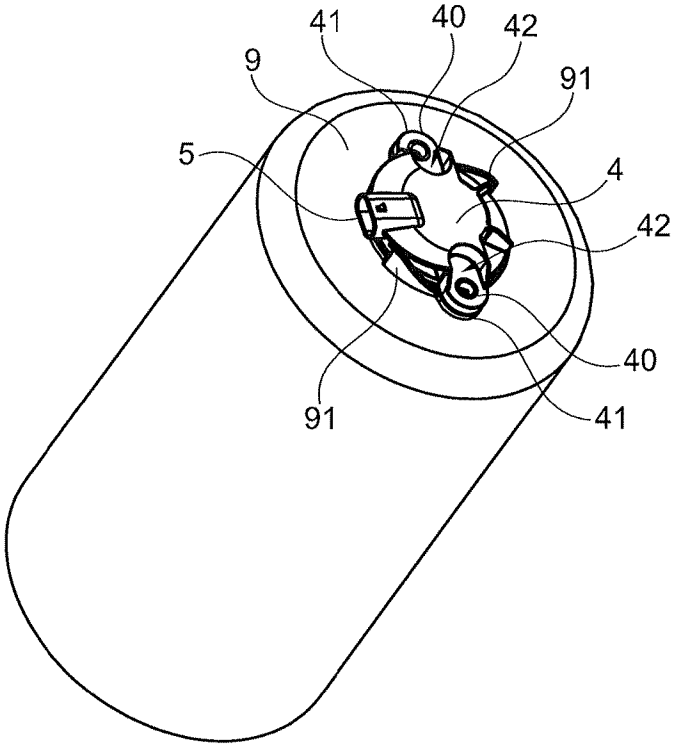
FIG. 3*a* is a perspective view of an assembly being introduced into a well of a cylinder head.
Figure 4:
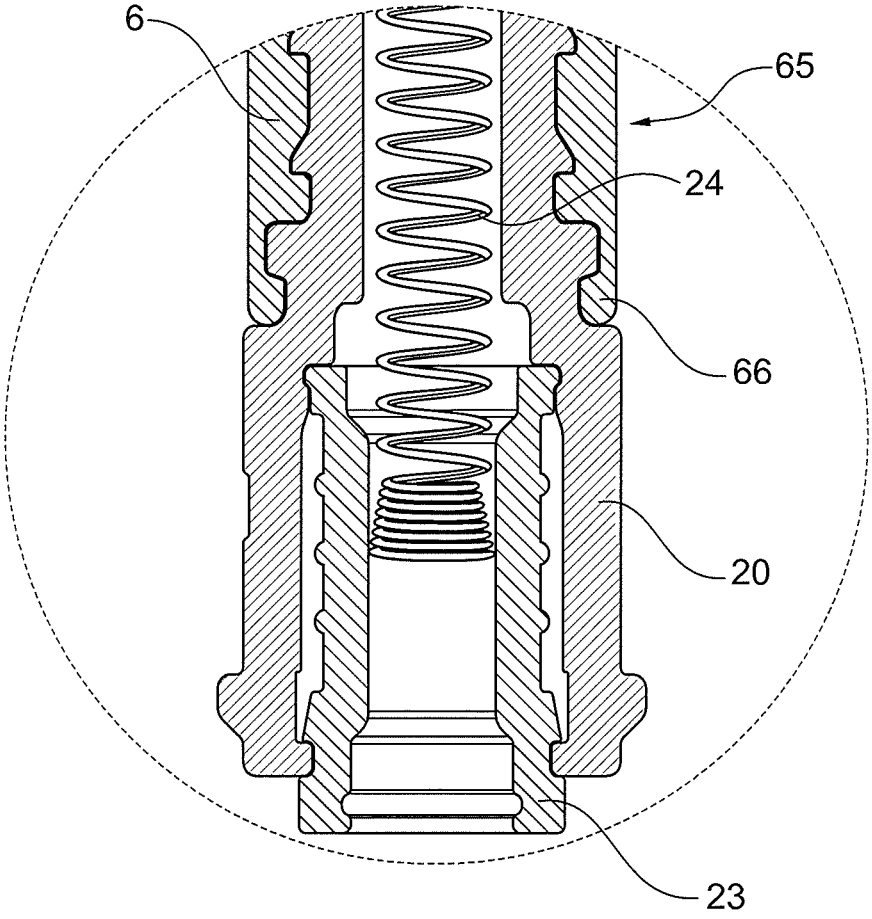
FIG. 4 is a close-up view according to encircled IV in FIG. 2.
Figure 5:
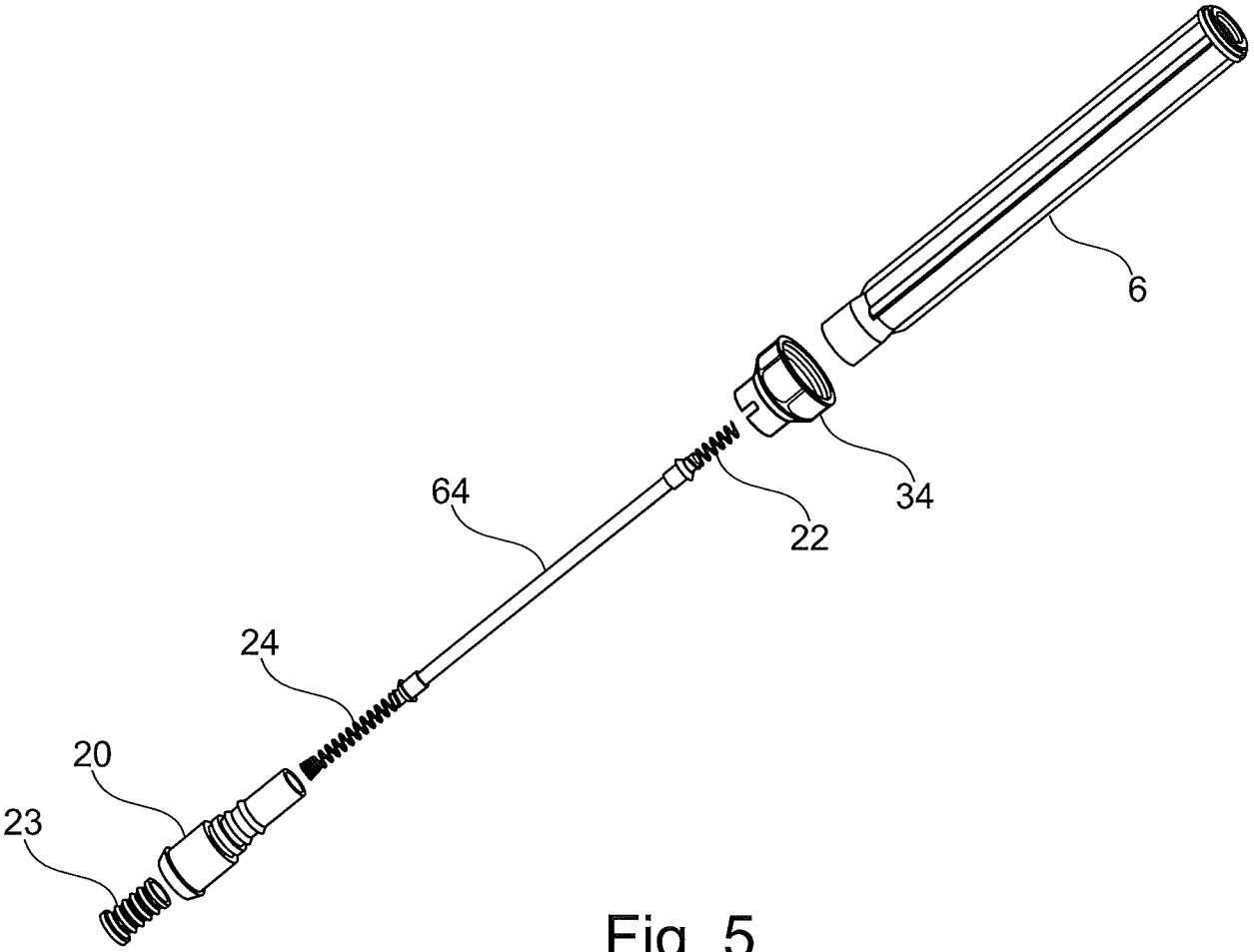
FIG. 5 is an exploded view of the assembly according to one embodiment of the invention.
Figure 6:
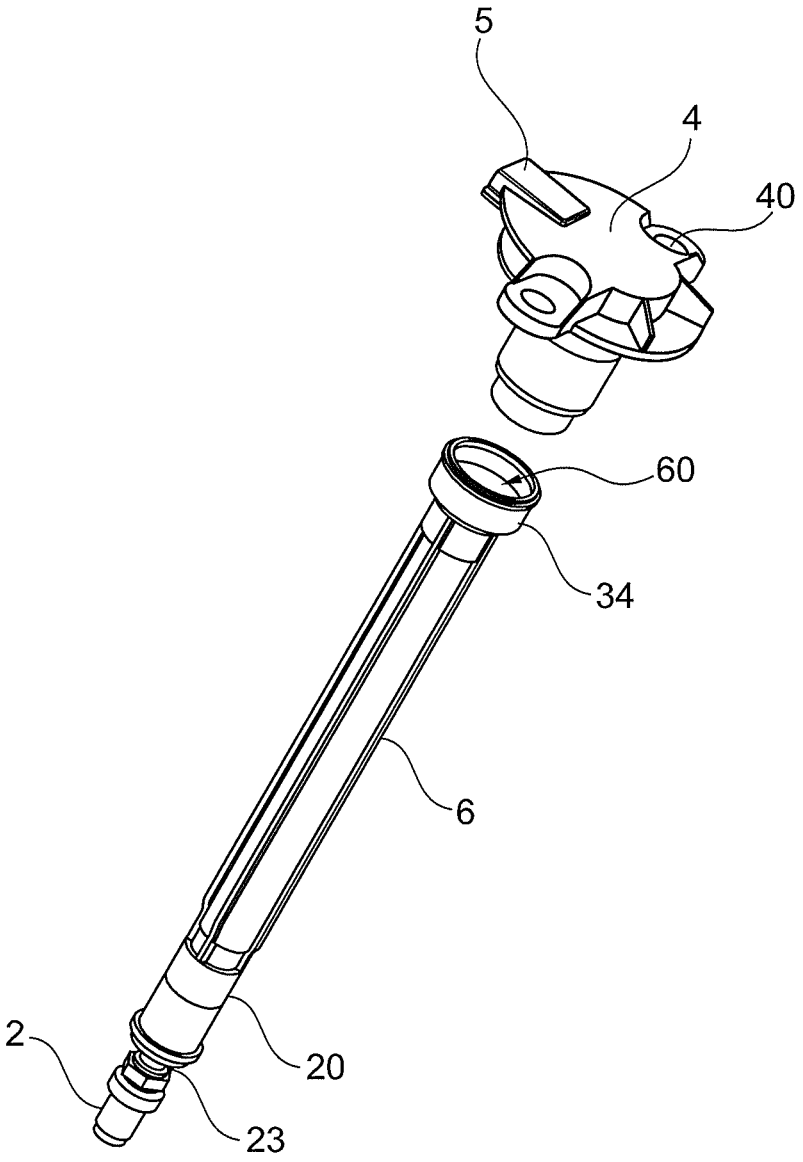
FIG. 6 is another exploded view of the assembly according to one embodiment of the invention.

The assembly 1 is seen to be provided with a spark plug 2 in FIGS. 3*a*-*b*, where said spark plug 2 is releasably inserted into the spark plug receiving end portion 10 of the assembly 1. The spark plug 2 is detachably arranged within an spark plug boot 23 which is removably mounted onto a second joining section 66 at a lower end portion 65 of the extension body 6. In one embodiment the spark plug boot 23 is located within an adaptor unit 20 (also referred to as "spark plug casing" or "boot adapter") which in its turn is attached to the second joining section 66 of the elongated extension body 6. Said boot adapter is preferably made of a material which is heat resistant and preferably an electrical insulator both in high-temperatures and in humid conditions. Examples of suitable material could comprise ceramics or thermoplastics such as polyphenylene sulfide (PPS). The spark plug boot 23 is preferably detachable from the assembly 1, for instance by means of a snap-in mechanism and may thereby easily be replaced if desired. According to one embodiment the spark plug boot 23 is attached to the boot adapter 20 by means of a snap-in mechanism such that the spark plug boot 23 can be detached from the adaptor 20 regardless of whether the spark plug has gotten stuck to it: over time, silicone rubber can bond with the silicon ceramic of the spark plug, fusing the boot and the spark plug together so that the spark plug gets stuck.

It is to be understood that the invention also relates to an embodiment where the ignition coil 3 is positioned directly adjacent to the ignition plug, and said elongated extension body 6 is connected to the ignition coil so as to form an extension of the assembly 1 to promote easy removing and/or introducing the ignition coil assembly from/into the motor.

Preferably the diameter of the spark plug boot 23 is smaller than the diameter of the spark plug wrench so that it is still possible to remove/replace the spark plug if it should get stuck. Thus it is possible to remove the plug 2 for instance using a conventional spark plug socket. In one embodiment the spark plug boot 23 is arranged to be removed and discarded together with the spark plug. Preferably the spark plug boot 23 is dimensioned to both being easily detachable from the adaptor unit 20 and to allow for a socket to reach the spark plug 2 properly. Preferably said spark plug boot 23 is made of a flexible, heat resistant and isolating material, such as silicone rubber, whereby there is achieved an efficient insulator between the spark plug 2 and the second joining section 66 of the extension body 6. The spark plug boot 23 is dimensioned to tightly embrace the spark plug thereby creating an efficient isolating layer and preventing leakage of high voltage current. Thanks to the spark plug boot 23 there is also achieved the advantage that the spark plug 2 is prevented from getting stuck to the adaptor unit 20 because the spark plug boot 23 creates a protecting layer which leads to facilitated detaching of the spark plug boot 23.

The function of the assembly 1 according to one aspect is now to be described. A direct ignition assembly 1 according to the invention, shown in FIGS. 1-6, is provided, and an spark plug 2 is fitted into the spark plug boot 23 at the lower end portion 65 of the assembly 1. Fitting into place of the plug 2 results in electrical connection with the coil 3 disposed above the plug 2, via said interconnecting member 64 (e.g. cable and/or spring). The assembly 1 is introduced into the well 90 of the cylinder head 9 so that the spark plug terminal is brought into contact with the interior of the combustion chamber. This operation is significantly facilitated by means of said extension body 6 being resilient and flexible since this allows for bending of the assembly 1 during that the lower end portion 65, comprising the spark plug terminal 2, is brought to a proper position for entering the well 90. As an example, if the space available under the hood of a particular vehicle is very narrow and at the same time the well 90 is lengthy, introducing a conventional, rigid ignition coil assembly would be rather cumbersome. However, an assembly 1 according to the invention will allow for easy and swift introduction even when the well 90 is deep and the assembly body is correspondingly elongated. Bending of the extension body 6 allows for firstly introducing the spark plug end portion 10, while at the same time the upper end portion 62 at the position of the coil 3 may be forced to assume an angle a in relation to the main axis A and to the alignment of the spark plug receiving end portion 10. An assembly 1 according to the invention can hereby be introduced into a well 90 without encountering the problem of the hood blocking the ignition coil assembly from entering the well: if the hood is in the way the extension body 6 is simply bent so that introduction operation may proceed.

Once the entire assembly body 1 is in place inside the well 90 a coil housing 4 at the uppermost end of the assembly 1 is arranged to secure the assembly onto the engine head 9 so that the well 90 and the chamber is properly sealed. The coil housing 4 is attached onto the head 9 by means of fastening means 40 such as screws or any other conventional/suitable alternative. The coil housing 4 comprise a connector body 5 for electrically connecting the primary terminals of the coil 3.

In FIG. 3*a* there is seen a view of an example of a coil housing 4 at the upper end portion of an assembly 1 which has been inserted and secured into a well 90 of a cylinder head 9. As seen herein the coil housing 4 is arranged with transversally protruding members 41, referred to as "mounting ears", providing a fastening structure via which the fastening means 40 can fasten the seal 4 onto the engine head 9. Fastening may be achieved in many ways, such as via screws or by means of a bayonet coupling. The mounting ears 41 are preferably arranged adjacent to gripping surfaces 42 for facilitating removal of the assembly 1 out of a well 90 as will now be described. According to one aspect of the invention the orifice of the spark plug well 90 of the engine head 9 comprises lifting cams 91 which are arranged to cooperate with the mounting ears 41 of the seal 4 to contribute to removal of the assembly 1 out of a well 90. When removing an assembly 1 out of a well 90 the fastening means 40 (if present) are firstly detached whereafter the seal 4 is grasped at the position of the gripping surfaces 42 and the seal 4 rotated such that the mounting ears 41 are urged to slide up and onto the lifting cams 91. Hereby the entire assembly 1 is lifted in a direction out of the well 90 simultaneous to the rotational movement. This provides for simple and efficient detaching of the assembly 1 from the well 90.

The invention is not to be seen as limited by the embodiments described above, but can be varied within the scope of the appended claims. For instance, the flexible material of the extension body may be a material other than rubber, and further the extension body may vary in length depending on the depth of the well 90.

Many other variations are also possible, as will be readily understood by the person skilled in the art.

The invention claimed is:

1. An ignition coil assembly for an ignition system comprising an ignition coil (3) where said assembly (1) has a main axis (A) extending between an upper terminus of the assembly (1) and a lower terminus of the assembly (1) spaced a predetermined distance from the upper terminus of the assembly (1) and is configured for insertion into and/or removal out of a well (90) associated with an internal combustion engine, and said assembly (1) comprises an elongated extension body (6) made of flexible material that is bendable without breaking, said extension body (6) comprising an upper end portion (62) and a lower end portion (65) wherein the extension body (6) is arranged to be transversally bendable in relation to the main axis (A) along at least 25 percent of said predetermined distance between the upper and lower termini of the assembly (1) so that the upper end portion (62) and the lower end portion (65) is capable of assuming an angle (a) that is different from a straight angle of 180 degrees in relation to each other characterized in that a spark plug (2) is detachably arranged within a spark plug boot (23) which spark plug boot (23) is detachably arranged within a boot adapter (20) attached at the lower end portion (65) of the extension body (6), wherein the spark plug boot (23) has a an outermost diameter that is smaller than a an innermost diameter of the boot adapter.

2. The assembly according to claim 1, wherein the elongated extension body (6) interconnects a spark plug receiving end portion (10) and the ignition coil (3) to each other and which is arranged to be transversally bendable in relation to the main axis (A) so that the spark plug receiving end portion (10) and the ignition coil (3) are configured to assume an angle in relation to each other.

3. The assembly according to claim 2, wherein said ignition coil (3) is detachably arranged within a first joining section (63) at an upper end portion (62) of the extension body (6).

4. The assembly according to claim 3, wherein said extension body (6) is made of a flexible rubber material.

5. The assembly according to claim 4, wherein said extension body (6) has a length that is between 100-500 mm.

6. The assembly according to claim 5, comprising a coil housing (4) arranged with means (40, 41) for connecting an assembly (1) which is positioned inside the well (90) onto a corresponding cylinder head (9), which coil housing (4) further comprises transversally projecting mounting ears (41) arranged to cooperate with vertically protruding lifting structures on the cylinder head (9) to promote easy removal of the assembly (1) out of the well (90).

7. Method for mounting an ignition coil assembly (1) into a well (90) of a cylinder head (9), comprising the steps of introducing the assembly (1) into said well (90) while adapting the assembly (1) to a space available around the cylinder head by means of transversally bending an extension body (6) in relation to a main axis (A) extending between an upper terminus of the assembly (1) and a lower terminus of the assembly (1) spaced a predetermined distance from the upper terminus of the assembly (1), wherein the extension body (6) is arranged to be transversally bendable in relation to the main axis (A) along at least 25 percent of said predetermined distance between the upper and lower termini of the assembly (1) so that a spark plug portion (65) and an ignition coil (3) are configured to assume an angle in relation to each other that is different from a straight angle of 180 degrees, wherein a spark plug boot (23) is detachably arranged within a boot adapter (20) attached at the spark plug portion (65) of the extension body (6), wherein the spark plug boot (23) has a an outermost diameter that is smaller than a an innermost diameter of the boot adapter (20), and fastening the assembly (1) to the cylinder head (9) via a coil housing (4).

8. The assembly according to claim 1, wherein said ignition coil is detachably arranged within a first joining section at the upper end portion of the extension body.

9. The assembly according to claim 1, wherein said extension body has a length that is between 100-500 mm.

10. The assembly according to claim 1, wherein said spark plug boot is detachably arranged within the boot adapter attached at the lower end portion of the extension body.

11. The assembly according to claim 1, comprising a coil housing arranged with means for connecting an assembly which is positioned inside the well onto a corresponding cylinder head, which coil housing further comprises transversally projecting mounting ears arranged to cooperate with vertically protruding lifting structures on the cylinder head to promote easy removal of the assembly out of the well.

12. The assembly according to claim 1, wherein said boot adapter is made of a heat resistant material.

* * * * *